US005244340A

United States Patent [19]

Pizzi et al.

[11] Patent Number: 5,244,340

[45] Date of Patent: Sep. 14, 1993

[54] SEMIAUTOMATIC EQUIPMENT FOR THE SEPARATION OF LOOSE LARGE SIZE REAMS FROM A STACK OF SINGLE SHEET

[75] Inventors: Fausto Pizzi, S. Giovanni in Persiceto; Davide Dall'Omo, Bologna, both of Italy

[73] Assignee: Wrapmatic, S.P.A., Bologna, Italy

[21] Appl. No.: 718,619

[22] Filed: Jun. 21, 1991

[30] Foreign Application Priority Data

Jul. 17, 1990 [IT] Italy ..... 3602A/90

[51] Int. Cl.[5] ..... B65H 3/00

[52] U.S. Cl. ..... 414/796; 414/796.2; 414/796.8; 414/796.9

[58] Field of Search ..... 414/796, 795.9, 796.2, 414/796.8, 796.9

[56] References Cited

U.S. PATENT DOCUMENTS

| | | | |
|---|---|---|---|
| 3,176,859 | 4/1965 | Prager | 414/796.8 X |
| 4,551,053 | 11/1985 | Ishibashi | 414/796 |
| 4,623,292 | 11/1986 | Suzuki et al. | 414/796 |
| 5,102,293 | 4/1992 | Schneider | 414/796.9 X |

*Primary Examiner*—David H. Bollinger
*Attorney, Agent, or Firm*—Laff, Whitesel, Conte & Saret

[57] ABSTRACT

The semiautomatic equipment included a pair of horizontal knives disposed mutually parallel, adjustable for height, and positioned a short distance from the edge of a stack of sheets for penetrating the depth of one ream, selected previously by hand. The knives are carried slidably by a beam suspended over the stack of sheets between the rails of a frame and are therefore capable of relative movement parallel with the width of the stack. The knives are movably attached to the beam by way of a carriage having guides which provide a degree of movement parallel with the length of the stack, such that an operator can bring about the initial insertion by hand before applying an actuator to lock the knives to the carriage when fully penetrated within the stack of sheets. The entire assembly of beam, carriage and knives is traversed along the frame by further actuators that are triggered to operate by a sensor mounted to the knives, and thus causing the separated ream to be moved forward to a wrapping station.

7 Claims, 2 Drawing Sheets

A
C
1
17
22
21
5
5a
13a
14
7
13
14a
15
12a
4
20
6
F
1a
5
13
12
18
19
3
30
2
2a
8
16
6
11
9
10
P

SEMIAUTOMATIC EQUIPMENT FOR THE SEPARATION OF LOOSE LARGE SIZE REAMS FROM A STACK OF SINGLE SHEET

BACKGROUND OF THE INVENTION

The present invention relates to semiautomatic equipment for the separation of loose reams, with or without the use of markers from a stack of large size sheets.

A widely experienced problem in the field of papermaking artwork generally, is to effect the separation of stacked sheets into reams for handling by wrapping machinery. This problem is especially prevalent with the larger sized sheets, such as those used for layout and design drawings and artwork. In general, sheets of paper to be wrapped in reams are stacked, palletized and conveyed from the papermaking machine to the wrapping machine. The pallet used in this process is positioned on an elevator which rises automatically each time a wad of sheets equivalent in number to one ream is removed from the top by an operator. Thus, the height at which the reams are separated from the stack remains constant. In most cases, the single reams are separated from the stack by means of an instrument similar to a gage in which the measuring arms consist of a fixed reference element and a moving element resembling a blade which is insertable between two adjacent sheets. The operator first sets the depth of the ream to be separated from the stack. Next, the operator places the reference arm on the topmost sheet and slides the gage forward to the point at which the blade inserts between two sheets and thereby separates a ream of the selected size from the remainder of the stack.

In another method similar to that outlined above, the sheets are counted by the stacking machine and a marker is inserted between one sheet and the next each time a number of sheets corresponding to one ream is counted off. The marker is a piece of generally colored paper or other similar material which is positioned to project from the stack of sheets. Thus, the operator must raise the part of the stack above the marker, using the gage instrument in the manner described above, and push it toward the wrapping machine.

Whilst the latter method mentioned is extremely accurate, there is the drawback that the markers may not always be inserted in the same position because of both the difference in sheet sizes and the different types of machines by which the sheets are stacked.

Irregardless of the method adopted, the separating and maneuvering operations for splitting up the stacked sheets into reams is entirely manual. This is especially burdensome for and tiring to an operator considering the high production tempo of the wrapping machines and the size and considerable weight of the reams.

Accordingly, object of the present invention is to overcome the drawbacks mentioned above through the embodiment of semiautomatic equipment that allows an operator to separate a stack of paper sheets into reams with accuracy, speed and ease, regardless of whether or not the reams have been counted off previously and marked.

A further object of the present invention is to provide equipment in which the fundamental object thus set forth can be realized economically and with every possible functional advantage.

SUMMARY OF THE INVENTION

The stated objects are realized in semiautomatic equipment according to the invention, essentially comprising: a pair of horizontal knives mutually disposed and parallel to one another and set at a short distance from the edge of a stack of sheets. The horizontal knives are vertically adjustable for height by positioning means and are designed to penetrate beneath a ream of sheets selected previously by hand. A supporting guide member is disposed horizontally above the stack of sheets and connected positively at either end to a bearing structure. The knives are slidably associated with the supporting guide member for adjusting their position in a direction parallel to and through a distance commensurate with one of the dimensions of the stack. A carriage for supporting the knives is slidably mounted to the horizontal guide member and includes respective guides along which the knives are slidable in a direction parallel to a longitudinal dimension of the stack of sheets and thereby insertable into the stack beneath the bottom sheet of a previously selected ream. Locking means associated with the carriage are used to hold the knives in a stable position of penetration. Traversing means impinge on the horizontal guide member and direct the previously selected ream to a wrapping station subsequent to a signal from sensing means that are mounted to the knives.

One of the advantages afforded by the present invention derives from the fact that the step of separating each ream from the stack of sheets is entrusted to manual intervention. Which ensures a notable accuracy in the operation of the separation process. Another advantage of the present invention is that the step of transferring the ream to the wrapping machine is effected automatically by means of the knives and the traversing guide member which results in a lightening of the operators workload.

BRIEF DESCRIPTION OF THE DRAWINGS

The invention will now be described in detail, by way of example, with the aid of the accompanying drawings, in which.

DESCRIPTION OF THE PREFERRED EMBODIMENTS

Figure 1:
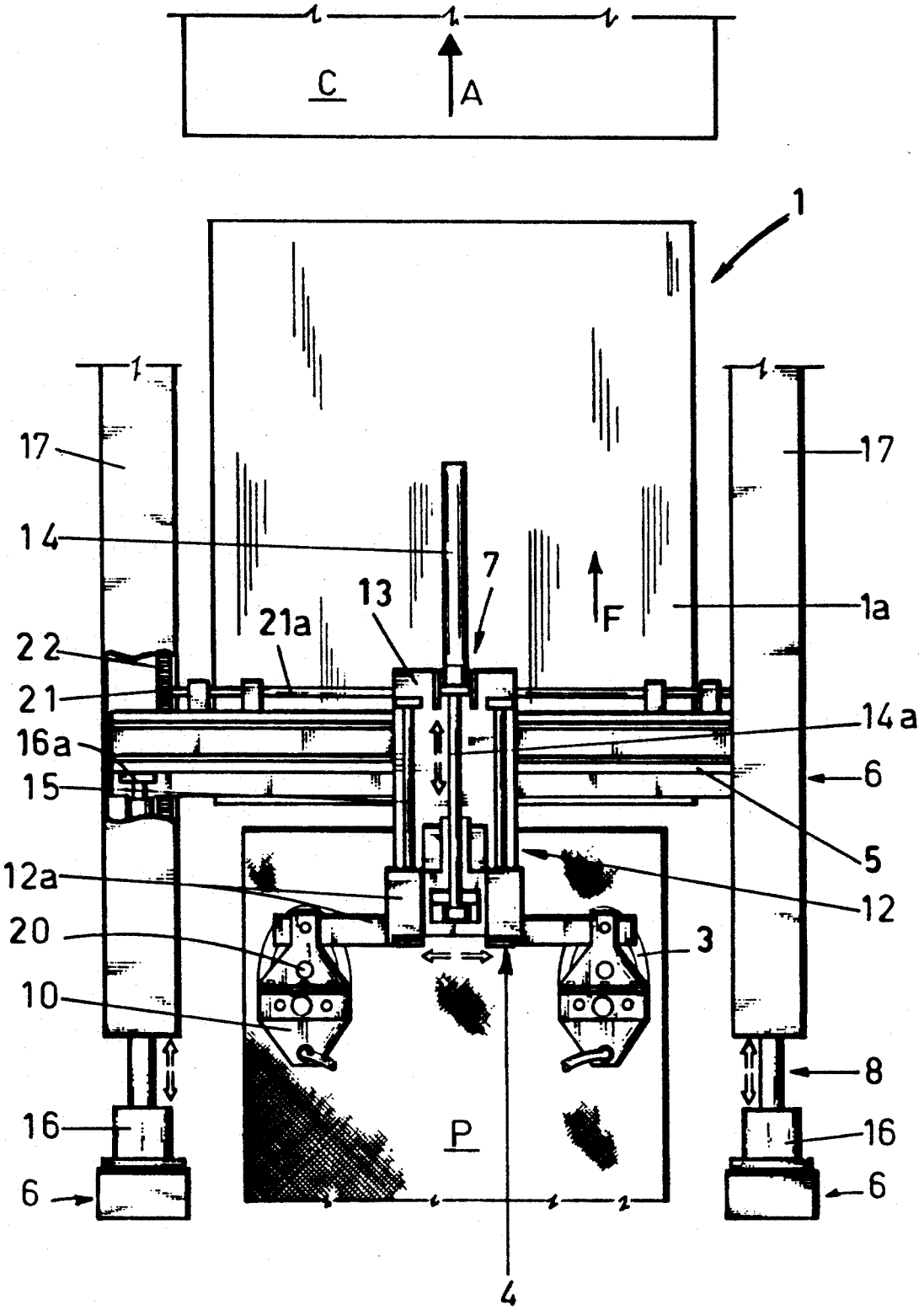
FIG. 1 is a schematic illustration of semiautomatic equipment according to the invention, shown in plan view.

With reference to the accompanying drawings, the purpose of the semiautomatic equipment, as disclosed, is to permit separation of a stack of single sheets of paper into loose reams. The stacked sheets 1 rest on a pallet 2*a* and are supported by an elevating platform 2 which is located adjacent to a station for wrapping the reams which have been separated by an operator with the aid of a conventional gage (not illustrated). The station is schematically illustrated and denoted by reference letter "C" in FIG. 1.

In the preferred embodiment, as shown, the semiautomatic equipment essentially comprises a pair of horizontal knives 3 (see FIG. 1) for detaching a single ream 1*a* (which was previously selected by hand) a transversely disposed guide member 5 for supporting a carriage 12 to which the knives 3 are mounted, means 7 for locking and holding; the knives 3 in a given position, and means 8 for traversing or slidably moving the supporting guide member 5. More exactly, as shown in FIG. 2, the knives 3 are disposed in parallel relationship to one another and a short distance from the edge of the stack of sheets 1 closest to the wrapping station C. The knives 3 each include a tapered end which is closest to the sheets 1 for their easy insertion and penetration beneath the bottom sheet of the previously selected ream 1*a*. Moreover, each knife 3 is rigidly connected with and includes a corresponding handle 10 which is connected in turn to one of a pair of cylinders 11 that are perpendicularly disposed. Additionally, the cylinders 11 and, indirectly, the knives 3 are attached to constituting means 4 which provide movement to the knives in a vertical direction for adjusting the height of the penetration of the knives into the stacked sheet.

The above-mentioned cylinders 11 are mounted indirectly to the carriage 12 by way of corresponding slide brackets 12*a* that are disposed in parallel relationship to the supporting guide member 5, which allows the knives 3 to be drawn together or spread apart. Also associated with the carriage 12 are two arms 13 (see FIG. 2) which extend from carriage 12 at angles. Rollers 13*a* include free ends which positively engage in the horizontal guide member 5 which support and maintain the locking means 7. The carriage 12 also includes a pair of longitudinal guides 15 along which the respective knives 3 are slidable in a direction parallel to a longitudinal dimension of the stack of sheets 1. The guides 15 include an at-rest position in which the knives 3 are distanced from the guide member 5 and an operative position in which the knives 3 are drawn up to the guide member and inserted into the stack 1 beneath the previously selected ream 1*a*.

Figure 2:
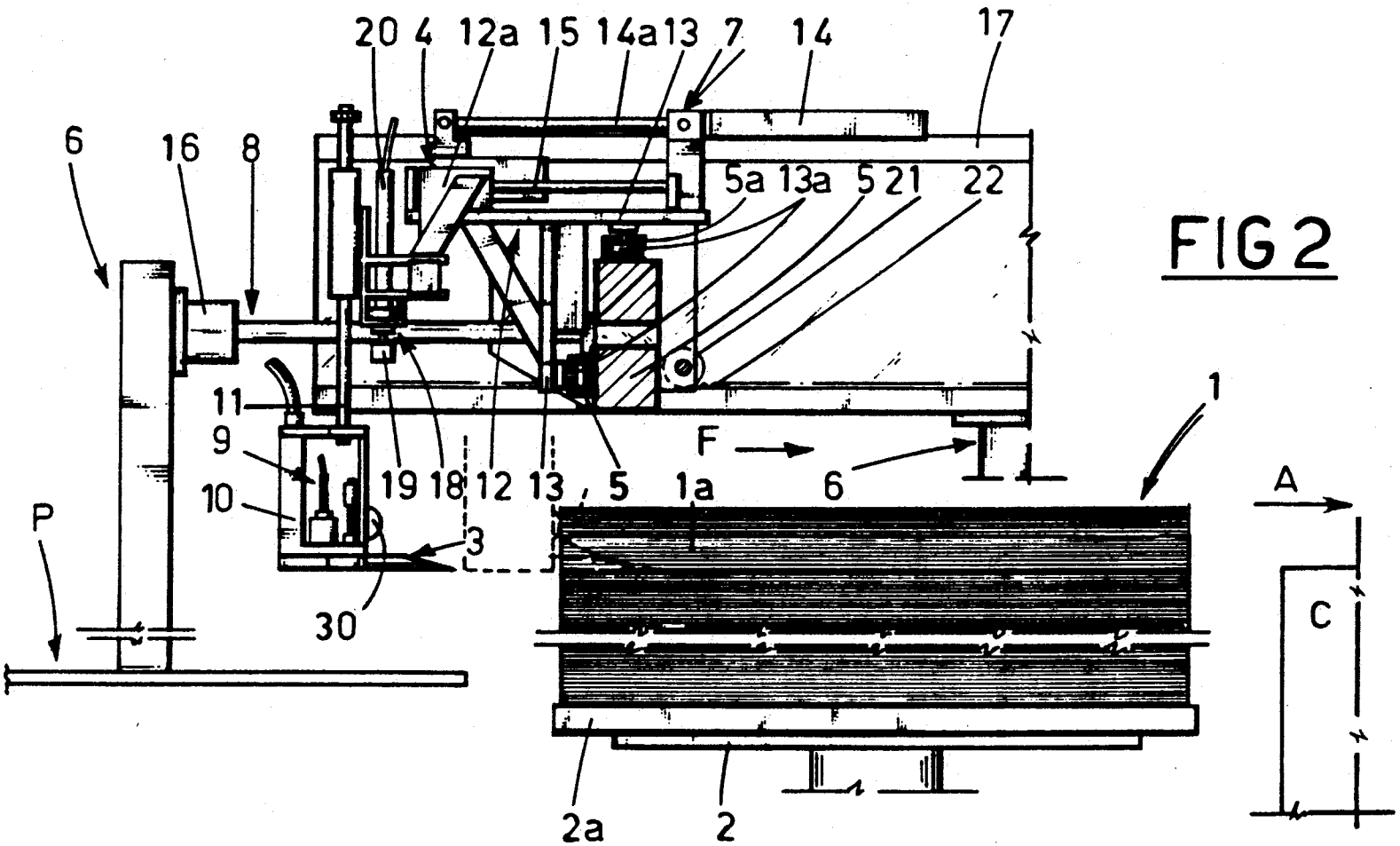
FIG. 2 is a side elevational view of the equipment of FIG. 1.

The supporting guide member 5 is positioned above the stack of sheets 1, as shown in FIGS. 1 and 2, and is connected positively at each end to a bearing structure 6 (described in greater detail hereinafter). As shown in the Figures, the guide member 5 consists of a beam having a pair of tracks 5*a* wherein one of the tracks is located on the uppermost face of the beam and the other track is located on the side face of the track adjacent the knives 3. The tracks 5*a* of the guide member 5*a* allow for the carriage 12 to be slidably moved or traversed which thereby alters the position of the knives 3 in a direction perpendicular with a transverse face of the stack of sheets 1 or, the edge of sheets with which the knives 3 enter into contact. Locking means 7 consists of a fluid power cylinder 14 (FIG. 2) which is disposed longitudinally above and perpendicular to the guide member 5. Power cylinder 14 includes a rod 14*a* which is connected at its free end with both the slide brackets 12*a*. Which, in turn, are slidably connected with the two longitudinal guides 15. The guides are cylindrical bars that are disposed in parallel relationship to the fluid power cylinder 14 and further are rigidly associated with the horizontally disposed arm 13 of the carriage 12. The aforementioned connection of the cylinder 14 enables it to lock and hold the operative carriage 12 and the knives 3 in a position, i.e. in the position whereby the knives 3 are drawn up to the guide member 5. The traversing means 8 includes a pair of second cylinders 16 which are disposed in horizontal relationship to association the bearing structure 6 which is effectively a frame supporting the fixed components of the equipment. The rod end 16*a* of each second cylinder 16 is connected to a corresponding end of the supporting guide member or beam 5. The ends of the guide members associated with rails 17 on the bearing structure such that the guide member 5 can advance the separated ream 1*a* toward the wrapping station C in the direction of the arrow. This traversing movement of the guide member occurs on receipt of a signal generated by sensing means 9 which are associated with and adjacent to handle 10 the knives 3.

In the event that greater precision is required in the traversing movement of the supporting guide member 5, the rails 17 may be supplemented with a pair of horizontal racks 22 which are supported by the bearing structure 6 in conjunction with corresponding pinions 21. The pinions 21 are associated with the ends of the guide member 5 and are interconnected by a movable cross shaft 21*a*. The pinions 21 rotate in unison.

The sensing means 9, as shown in FIG. 2, include a conventional microswitch 30 which is mounted frontally to each handle 10 and which is connected both to the locking means 7 and to the traversing means 8. The above-described mounting of the microswitch 30 on the handles 10 allows for a stable arrest of the forward movement of the knives 3 and further triggers the operation of the locking 7 of and the traversing means 8 at the moment the switch 30 enters into contact with the edge of the ream 1*a*.

The carriage 12 also incorporates means 18 for compacting and stabilizing the previously selected ream 1*a*. The compacting and stabilizing means are secured perpendicularly above each of the knives 3. As shown in FIG. 2, such means 18 comprise a restraint 19 which is secured to the free end of the piston rod of a vertically disposed cylinder 20 that is mounted to the carriage 12 and interlocked to the sensing means 9. Thus the restraint 19 can be adjusted for clearance from the knives 3 according to the depth of the previously selected ream 1*a*. Operation of the equipment thus embodied will now be described.

The palletized stack of sheets 1 is placed on the platform 2 which is then elevated by the operator to bring the top edge of the stack substantially level with the wrapping station C. The operator is preferably on a pedestal P to the rear of the elevating platform 2, in the feed direction A, wherein the operator then a ream 1*a* for wrapping by lifting the edge of the stack with the gage. Thereafter, manual pressure is applied by the operator on at least one of the handles 10 for inserting the knives 3 longitudinally beneath the raised edge of the ream 1*a*. The contact of the knives 3 between the sheets 1 and the knives 3 activates the sensing means 9, i.e. the microswitch 30, which in turn triggers the operation of the cylinders 20 and the two attached restraints 19. The restraints are caused to descend and press the ream 1*a* of sheets 1 against the knives 3. At the same time, the knives 3 are locked in the operative position (phantom line shown in FIG. 2) by the relative cylinder 14 and the ream 1*a* is effectively separated from the remainder of the stack of sheets 1. The moment the carriage 12 has gained the forward position and is drawn up to the guide member 5, the second cylinders 16 are activated and the guide member 5 is moved forward (arrow F) along the direction (arrow A) in which the reams are fed toward the wrapping station C. Naturally, the instant that the ream 1*a* is taken up by the wrapping station C, the guide member 5 will be returned to its initial position. Similarly, the carriage 12 will be released by the cylinder 14 and distanced from the guide 5 in readiness for the separation of another ream.

In the event of a change in the size of sheet being handled, and, therefore, in the dimensions of the stack 1, the operator will make the appropriate adjustments including altering the distance between the knives 3 and also their height from the pedestal P. These adjusting means are made by means of the relative slide brackets 12*a* and cylinders 11. It will be evident from the foregoing description that equipment according to the invention affords certain significant advantages including, but not limited to, retaining previous manual selection of the number of sheets, and ensuring a constantly monitored and precise separation of the reams for transfer to the wrapping station. In the latter instance the transfer operation of the separated reams is effected automatically by the equipment and thus relieves the operator entirely of the tiring maneuvers required to effect such a step by hand. Moreover, the inventive equipment results in an increased number of reams wrapped per unit of time in comparison to prior art embodiments. A further advantage of the inventive equipment is that it can be utilized to equally good effect for stacks of sheets with or without ream markers.

To provide improved control over the operations effected automatically by the equipment, a unit might be installed alongside the operator station by means of which to conduct operations in single step mode rather than allowing them to occur in uninterrupted sequence. Such an expedient would be particularly convenient in the event of sudden or unforeseen stoppages at the wrapping station.

What is claimed is:

1. Semiautomatic equipment for the separation of large size reams, previously selected by hand, from a stack of sheets placed on an elevating platform and including a front end and a rear end defining a longitudinal feeding direction, the rear end preceding a wrapping station, comprising:

at least one pair of horizontally disposed knives, each of said knives including a tapered profile at one end and disposed parallel to one another at a short distance from a front edge of the stack of sheets, said knives being supported at an end opposite to said one end by knife support means which are adjustable in the vertical direction by relative positioning means, said one end profile of said knives being adjacent the stacks of sheets to enable said knives to forcibly penetrate into the stack of sheets beneath a bottom sheet of a ream previously selected by hand;

a supporting guide member disposed horizontally above the stack of sheets and transversely movable with respect to the feeding direction, said supporting guide member being slidably supported at either end to a bearing structure;

a carriage mounted slidably to said supporting guide member and including corresponding longitudinal guides which support said knife support means along which the knives are manually slidable parallel with said longitudinal feeding direction of the stack of sheets, said supporting guide member including an at-rest position in which the knives are distanced from the supporting guide member, and an operative position in which the knives are drawn up close to the supporting guide member and inserted into the stack beneath the bottom sheet of the previously selected ream;

locking means acting on said supporting knife means for locking said knife support means in the operative position;

traversing means acting on said supporting guide member for moving said supporting guide member and said knives so that the selected ream may be moved toward a wrapping station positioned along said feed direction; and sensing means mounted adjacent the knives and relaying a signal to the operative position.

2. The semiautomatic equipment of claim 1, wherein each of said knives is rigidly connected to a corresponding handle, and wherein said supporting knives means include at least one cylinder connected to the handle, said cylinder perpendicularly disposed to the knife and rigidly connected to an arm horizontally and transversely disposed with respect to the feeding direction, said arm being connected to a central element slidably connected to said longitudinal guides said knives being drawn together and spread apart, and supported together with the locking means by a pair of said arms of which the free ends carry rollers slidably and positively engaging with the guide member.

3. The semiautomatic equipment of claim 2, wherein said locking means comprises a fluid power cylinder disposed perpendicular to and above the supporting guide member, said fluid power cylinder including a rod which is rigidly connected at its free end with said central element and wherein the longitudinal guides include respective cylindrical bars which are disposed parallel to the fluid power cylinder and secured to said carriage.

4. The semiautomatic equipment of claim 2, further comprising compacting means associated with the relative horizontal arm for compacting and stabilizing a previously selected ream, said compacting means adjacent to and disposed vertically above each of the knives and capable of movement in an at-rest position wherein the knives are raised and distanced from the ream, and a lowered operative position wherein the knives are in contact with the ream.

5. The semiautomatic equipment of claim 1, wherein said traversing means includes a pair of second cylinders that are mounted horizontally to the bearing structure and are connected respectively to the ends of the guide member which, in turn, are connected between rails on the bearing structure.

6. The semiautomatic equipment of claim 5, wherein the horizontal supporting guide member is movably connected to pinions, said pinions being interconnected by a single shaft and in conjunction with corresponding horizontal racks which are rigidly connected to the bearing structure.

7. The semiautomatic equipment of claim 1, wherein said sensing means are positioned adjacent the handle of at least one knife.

* * * * *